United States Patent [19]

Maa

[11] 4,022,680

[45] May 10, 1977

[54] HYDROGEN DONOR SOLVENT COAL LIQUEFACTION PROCESS

[75] Inventor: Peter S. Maa, Baytown, Tex.

[73] Assignee: Exxon Research and Engineering Company, Linden, N.J.

[22] Filed: Dec. 17, 1975

[21] Appl. No.: 641,489

[52] U.S. Cl. ..... 208/8

[51] Int. Cl.[2] ..... C10G 1/06

[58] Field of Search ..... 208/8

[56] References Cited

UNITED STATES PATENTS

| | | | |
|---|---|---|---|
| 2,049,013 | 7/1936 | Lowry | 208/8 |
| 2,242,822 | 5/1941 | Fuchs | 208/8 |
| 3,594,304 | 7/1971 | Seitzer et al. | 208/8 |

*Primary Examiner*—Delbert E. Gantz
*Assistant Examiner*—James W. Hellwege
*Attorney, Agent, or Firm*—Llewellyn A. Proctor

[57] ABSTRACT

A process for liquefying a particulate coal feed to produce useful petroleum-like liquid products, particularly by steps which include: (a) contacting, in a liquefaction zone, said coal feed with a hydrogen donor solvent at temperature and pressure sufficient to hydroconvert and liquefy the coal (b) separating the product from the liquefaction zone by distillation into fractions inclusive of a liquid fraction which contains at least 30 weight percent, and preferably at least 50 weight percent hydrogen donor compounds, particularly those fractions boiling within about the 350°–850° F. range, and preferably within about the 400°–700° F. range, (c) hydrogenating said liquid fraction in a hydrogenation zone, (d) adding to said liquid fraction a solvent characterized as a low molecular weight heterocyclic oxygen or heterocyclic sulfur compound containing, within a molecule, from 2 to about 6 fused rings one or more of which is a five- or six-membered heterocyclic ring having 4 to 5 carbon atoms and from 1 to 2 atoms of oxygen or sulfur, and (e) recycling the hydrogenated liquid solvent mixture to said coal liquefaction zone.

21 Claims, 1 Drawing Figure

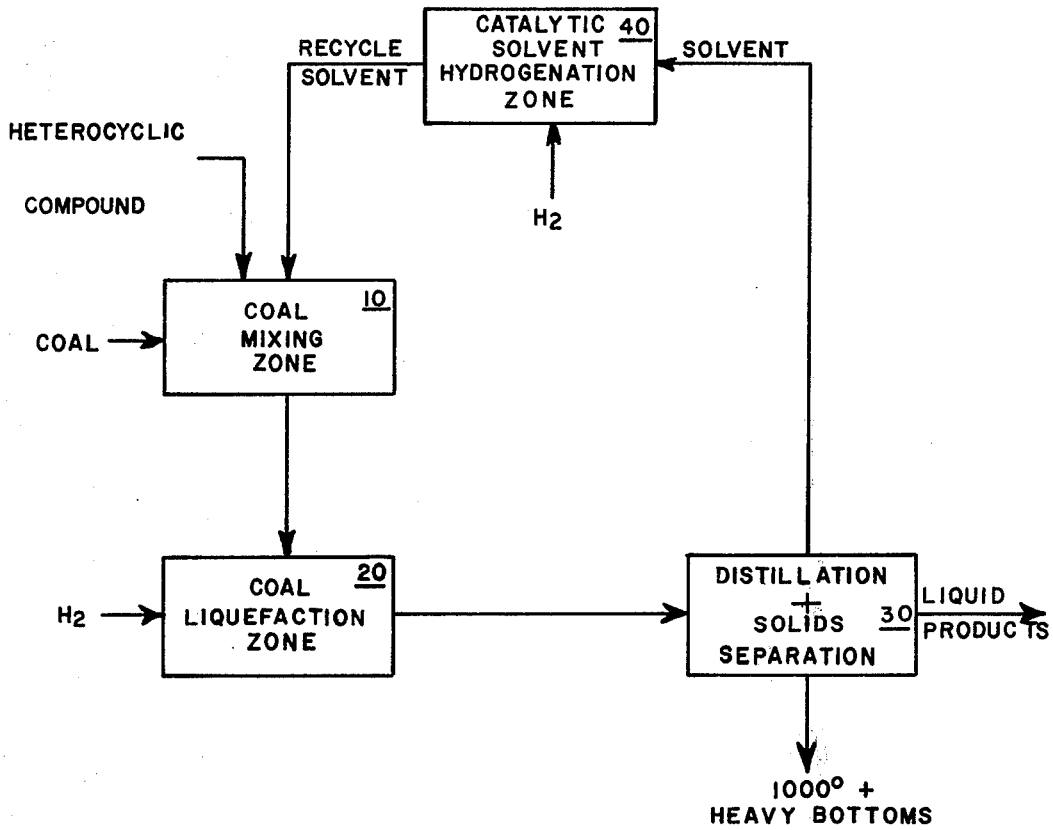
FIGURE

HYDROGEN DONOR SOLVENT COAL LIQUEFACTION PROCESS

Processes for the conversion of coal into useful petroleum-like liquid products have been known for many years. Of particular interest are those which utilize a hydrogen transfer, or hydrogen donor solvent to hydrogenate and liquefy the coal. In such processes, crushed coal is contacted at elevated temperature and pressure with a selective solvent, often a liquid fraction derived from within the process, which acts as a hydrogen donor to supply hydrogen to the hydrogen-deficient coal molecules, as molecules are thermally cracked and cleaved from disintegrating coal solids.

In breaking coal molecules, since coal largely comprises polymerized multi-ring hydroaromatic structures, each bond rupture results in the formation of two extremely reactive free radicals. These moities are stabilized by the addition of a hydrogen atom, and those which are sufficiently small are evolved as a portion of the liquid product. If excessively large, the fragments remain with the char that is produced. If insufficient hydrogen is available, polymerization of the moities occurs, this producing char or coke.

Coal is not a pure hydrocarbon and, whereas much of the coal has been successfully converted to useful petroleum-like liquids, the amount of such liquids which can be produced is quite variable. The liquid products themselves vary considerably in composition, and liquids are only a portion of the total products that are produced. Coal contains bitumin and humin which have large, flat, aromatic, lamellar structures that differ in molecular weight, degree of aromaticity, oxygen, and nitrogen contents and degree of cross-linking. The product liquids produced from coal thus vary widely in composition. Coal also contains volatile matter, fusain, mineral matter, and sulfur, much as pyritic sulfur, inorganic sulfates and organic sulfur compounds. The product liquids thus contain fusinite and ash, as well as char and sludge, which must be separated from the liquids. The heavy products from such coal liquefaction processes, characterized as "liquefaction bottoms" and consisting of 1000° F.+ organics, ash and carbon residue (fusinite), consist largely of carbon, 60–70 weight percent, and about 20 weight percent ash. The liquefaction bottoms, which are less useful than the 1000° F.– liquids, generally contain 40–50 weight percent of the original feed coal to the process.

Such processes thus leave much to be desired in terms of carbon efficiency, which can be defined as the amount of conversion of carbon to useful liquid products. It is desirable to obtain higher levels of conversion, and to reduce the level of formation of the excessively high molecular weight hydrocarbons which occur in the process. One approach to improving carbon efficiency is described, e.g., in U.S. Pat. No. 3,700,583 issued to certain of my colleagues on Oct. 24, 1972. This process describes the use of quinones, particularly quinone derivatives of mono- and/or polynuclear aromatic compounds, certain halogens and halogen halides thereof as carbon-radical scavengers which are added with the hydrogen donor solvent to the coal liquefaction zone to increase the amount of low molecular weight hydrocarbons which are formed within the liquid product, as measured by an increase in the total amount of benzene-soluble liquids in the product. A preferred technique for adding quinones to the solvent, in accordance with this patent, is to treat a 700°–1000° F. fraction of the liquid product in an oxidation zone to form the quinone carbon radical scavengers. The vaporized 700°–1000° F. fraction is contacted with air in the presence of an oxidation catalyst at temperatures ranging from about 800°–1000° F., at atmospheric pressure. The product of this reaction, after condensation, is recycled to the coal liquefaction zone. Liquid yields of benzenesoluble hydrocarbons are improved on the order of about 7 to 10 weight percent (MAF coal), and higher.

The improvement in carbon efficiency, whatever the mechanism, is due to an improvement in the quality of the hydrogen donor solvent used in the coal liquefaction zone, as a result of the added quinones. Further improvements in coal liquefaction processes by improvement of the solvents used in donor solvent processes is highly desirable.

It is accordingly the primary objective of the present invention to supply this need.

A particular object is to provide new and improved donor solvent systems for use in coal liquefaction processes, particularly solvents which are suitable for improving carbon feed efficiencies by better utilization of coal feeds to produce greater quantities of the more useful liquids.

These and other objects are achieved in accordance with the present invention characterized generally as a process for liquefying a coal feed slurried in a hydrogen donor solvent in the presence of one, or both, of an added i. low molecular weight heterocyclic oxygen compound containing from 2 to about 6, and preferably from 2 to 3 fused rings, one or more, preferably one, of which is a five- or six-membered heterocyclic ring having from 4 to 5 carbon atoms in the nucleus, preferably 4 carbon atoms, and from 1 to 2 atoms of oxygen, preferably one atom of oxygen; or ii. low molecular weight heterocyclic sulfur compound containing from 2 to about 6, and preferably from 2 to 3 fused rings, one or more, and preferably one, of which is a five- or six-membered heterocyclic ring having from 4 to 5 carbon atoms in the nucleus, preferably 4 carbon atoms, and from 1 to 2 atoms of sulfur, preferably one atom of sulfur.

The process, in particular, is characterized as one for liquefying a particulate coal feed to produce useful petroleum-like liquid product by steps which include: (a) contacting, in a liquefaction zone, said coal feed with a hydrogen donor solvent at temperature and pressure sufficient to hydroconvert and liquefy the coal, (b) separating the product from the liquefaction zone by distillation into fractions inclusive of a liquid fraction which contains at least 30 weight percent, and preferably at least 50 weight percent hydrogen donor compounds, particularly those fractions boiling within about the 350°–850° F. range, and preferably within about the 400°–700° F. range, (c) hydrogenating said separated liquid fraction in a hydrogenation zone, (d) adding to said liquid fraction a solvent characterized as (i) a low molecular weight heterocyclic oxygen compound containing from two to about six, and preferably from two to three fused rings, one or more, and preferably one, of which is a five- or six-membered heterocyclic ring having from 4 to 5 carbon atoms in the nucleus, preferably 4 carbon atoms, and from one to two atoms of oxygen, preferably one atom of oxygen; or (ii) a low molecular weight heterocyclic sulfur compound containing from two to about six, and preferably from two to three fused rings, one or more, and preferably one, of which is a five- or six-membered heterocyclic ring having from 4 to 5 carbon atoms in the nucleus, preferably 4 carbon atoms, and from one to two atoms of sulfur, preferably one atom of sulfur, and (e) recycling the liquid solvent mixture to said coal liquefaction zone.

The heterocyclic oxygen or sulfur compound, or mixture of heterocyclic oxygen and/or sulfur compounds, added to the coal generated solvent fraction is one which is polar, stable, and capable of dissolving, at the conditions of operation, the high molecular weight hydrocarbons within the reaction mixture, particularly the 100° F.+ hydrocarbons. It is thus a strong solvent, whether or not it possesses hydrogen donor capabilities; but it may be both a strong solvent and a hydrogen donor compound, or mixture of such compounds. In terms of chemical composition, the heterocyclic oxygen, or heterocyclic sulfur compound is one comprised of fused polycyclic rings, suitably containing from two to about six, and preferably from two to three fused rings, at least one and preferably one of which is a five- or six-membered heterocyclic ring having from 4 to 5 carbons atoms in its nucleus, preferably 4 carbon atoms, and from one to two, preferably one atom which is either oxygen or sulfur. The heterocyclic ring is fused to another ring, or to more than one other ring which can be heterocyclic or non-heterocyclic, particularly aromatic. The molecule can be substituted or unsubstituted, and in terms of carbon atoms the total molecule can contain from 8 to about 36 carbon atoms, preferably from 8 to 20 carbon atoms, and most preferably from 8 to about 12 carbon atoms. Ring substituents which increase the polarity of the total molecule are particularly desirable, such groups as oxy, hydroxy, nitro, amino, acetamide, carboxy, carboxy amide, halo, alkyl, alkoxy, phenoxy and the like being preferred substituents, notably the methyl, methoxy, ethyl and ethoxy substituents. The substituting groups themselves can be substituted or unsubstituted, and more than one substituent, or substituting group, can be present in the molecule. The substituent group, or groups, can contain oxygen, nitrogen, or sulfur within the ring, or attached to a ring carbon atom. Exemplary of heterocyclic oxygen compounds of this character are benzofuran, naphthenobenzofuran, dibenzofuran, naphthenodibenzofuran, phenanthrenofuran, naphthenophenanthrenofuran, 1,2-benzopyran, 2-furo[3,4-c]-pyrazole, 2,7-dioxapyrene, spiro[benzofuran-3(2),4'-piperidine] and the like, and exemplary of heterocyclic sulfur compounds of this character are benzothiophene, naphthenobenzothiophene, dibenzothiophene, naphthenodibenzothiophene, phenanthrenothiophene, naphthenophenanthrenothiophene, 2-(o-nitrophenyldithio)benzothiazole, 10-thiaxanthenol, and the like.

The heterocyclic oxygen or sulfur compound must be one which is polar, and desirably one which also either possesses or can be hydrogenated such that it will possess donatable hydrogen in or near the ring, or both. Where the hydrogen donor quality does not exist in the heterocyclic oxygen or sulfur compound, however, this function can and must be added by admixture with a compound, or admixture of compounds, which supplies this characteristic. The heterocyclic oxygen or sulfur compound in its role as a hydrogen donor is thus an unsaturated compound of considerable stability at coal liquefaction conditions which can be further hydrogenated, preferably an aromatic compound which can be dehydrogenated in situ or ex situ of the coal liquefaction zone. On donation of the hydrogen at coal liquefaction conditions, the stability of the now unsaturated compound is retained. In the instance of an aromatic compound, the aromatic compound, e.g., contains hydroaromatic hydrogen which it donates, but remains stable at coal liquefaction conditions. In general, the heterocyclic oxygen or sulfur compound, or admixture of such compounds, boils within the range of from about 250° F. to about 850° F., and preferably from about 290° F. to about 700° F.

In accordance with the practice of this invention, the heterocyclic oxygen or sulfur compound, or admixture of such compounds, is added to a liquid fraction separated from the liquid products obtained from within the process, suitably a fraction boiling within the range of from about 350° F. to about 850° F., and preferably from about 400° F. to about 700° F. These fractions have been found admirably suitable as a solvent donor, solvent donor vehicle or precursor, and generally contain about 30 percent, and most often about 50 percent, of an admixture of hydrogen donor compounds, adequate to supply the necessary hydrogen under coal liquefaction conditions, based on the total weight of the recycled solvent. Where such amounts of hydrogen donor compounds are not present in a given solvent vehicle, additional amounts of these materials can be added. Suitably, the heterocyclic oxygen or sulfur compound is added to the solvent fraction in quantity ranging from about 3 to about 50 percent, preferably from about 5 to about 20 percent, based on the weight of total solvent fed into the coal liquefaction zone.

Preferred hydrogen donor compounds added to, or originally contained within a suitable solvent donor vehicle, include indane, dihydronaphthalene, $C_{10}$–$C_{12}$ tetrahydronaphthalenes, hexahydrofluorine, the dihydro-, tetrahydro-, hexahydro-, and octahydrophenanthrenes, $C_{12}$–$C_{13}$ acenaphthenes, the tetrahydro-, hexahydro- and decahydro-pyrenes, the dihydro-, tetrahydro-, hexahydro-, and octahydro-anthracenes, and other derivatives of partially saturated aromatic compounds. In terms of hydrogen donor potential, the solvent to which the heterocyclic oxygen or sulfur compound is added, at the time of its introduction into or use within the coal liquefaction zone, necessarily contains at least about 0.8 percent, and preferably from about 1.2 to about 3 percent of donatable hydrogen, based on the weight of total solvent introduced into the coal liquefaction zone. The preferred hydrogen donor solvent is one produced within the coal liquefaction process, and to which the heterogenous oxygen or sulfur compound is added. Suitably, the solvent is added to the coal in concentration adequate to provide a solvent-to-coal ratio ranging from about 0.8:1 to about 4:1.

The reason for the effectiveness of the heterogenous oxygen or sulfur compound, or admixture thereof, added to the solvent for increasing the conversion of coal to lower molecular weight, more useful liquid petroleum-like products is not understood. Whereas Applicant does not desire to be bound by any specific theory of mechanism, it is believed that the high solvency power of the heterogeneous oxygen or sulfur compound progressively enhances dispersion of the high molecular weight compounds, notably those boiling at 1000° F.+, as liquefaction proceeds. The free radicals produced by the thermal cracking of the large coal molecules are thus known to be extremely short-lived, and are formed principally at the solid interfaces wherein the coal solids particles are being dissolved. By improving contact between the hydrogen donor solvent and these moities, repolymerization of some of these moities with other molecules or with each other is suppressed. The greater effectiveness of the hydrogen donor molecules in their role of reaching the extremely reactive-free radicals as they are formed, and more effectively hydrogenating said radicals, is thus believed to account largely for these improvements.

During liquefaction, it is thus believed that the coal molecule is dispersed by the solvent to form aggregates of colloidal nature. In general, an aggregate has a polyaromatic nuclei of the coal micelle at its center. The polyaromatic nuclei is surrounded by high and low molecular weight aromatics. The high molecular weight aromatics are formed from disintegration of coal, and the low molecular weight aromatics from the hydroaromatic solvent after donation of hydrogen to the free radicals of coal. The outer layer of aromatics is surrounded by hydroaromatics and the latter are surrounded by more saturated compounds. The solvent, it is believed, tends to disperse or pull apart the aggregate, thereby enabling the donor solvent to contact the polyaromatic nuclei. Penetration of the liquefaction barrier, made possible by the addition of the solvent, has the effect of accelerating the hydrogen transfer to the thermally cracked coal free radicals.

In the best mode of practicing the present invention, the heterocyclic oxygen or sulfur containing compound, or admixture thereof, is added to a hydrogen donor solvent fraction produced from within the coal liquefaction process. In such process, schematically illustrated by reference to the FIGURE, the required process steps generally include (a) a mixing zone 10 within which particulate coal is slurried with an internally generated liquids fraction, suitably one within which the heterocyclic oxygen or sulfur compound has been added, (b) a coal liquefaction zone 20 within which the coal slurry and hydrogen are fed, and the coal liquefied, (c) a distillation and solids separation zone 30 within which a solvent fraction, a 1000° F.+ heavy bottoms fraction, and liquid product fraction are separated, and (d) a catalytic solvent hydrogenation zone 40 wherein the solvent fraction is hydrogenated prior to its being recycled to said coal liquefaction zone 20.

Within the coal liquefaction zone 20, the liquefaction conditions include a temperature ranging from about 700° F. to about 950° F., preferably from about 800° F. to about 850° F., with pressures ranging from about 300 psia to about 3000 psia, preferably from about 800 psia to about 2000 psia. Preferably, molecular hydrogen is also added to the liquefaction zone 20 at a rate from about 1 to about 6 weight percent (MAF coal basis), liquid residence times ranging from about 5 to about 130 minutes, and preferably from about 10 to about 60 minutes.

The product from the coal liquefaction zone 20 consists of gases and liquids, the liquids comprising a mixture of undepleted hydrogen-donor solvent, depleted hydrogen-donor solvent, heterocyclic oxygen or sulfur compound, or compounds, dissolved coal, undissolved coal and mineral matter. The liquid mixture is transferred into a separation zone 30 wherein light fractions boiling below 400° F. useful as fuel gas are recovered and intermediate fractions boiling, e.g., from 400° to 700° F. are recovered for use as a hydrogen donor solvent. Heavier fractions boiling from about 700° to 1000° F. are also recovered, and bottoms fractions boiling above 1000° F., including char, are withdrawn for use in the gasification process or for coking, as desired.

The solvent fraction or 400°–700° F. fraction is introduced into a catalytic solvent hydrogenation zone 40 to upgrade the hydrogen content of that fraction. The conditions maintained in hydrogenation zone 40 hydrogenate, and if desired, conditions can be provided which produce substantial cracking. Temperatures normally range from about 650° F. to about 850° F., preferably from about 700° F. to about 800° F., and pressures suitably range from about 650 psia to about 2000 psia, preferably from about 1000 psia to about 1500 psia. The hydrogen treat rate ranges generally from about 1000 to about 10,000 SCF/B, preferably from about 2000 to about 5000 SCF/B.

The hydrogenation catalysts employed are conventional. Typically, such catalysts comprise an alumina or silica-alumina support carrying one or more Group VIII non-noble, or iron group metals, and one or more Group VI-B metals of the Periodic Table. In particular, combinations of one or more Group VI-B metal oxides or sulfides with one or more Group VIII metal oxides or sulfides are preferred. Typical catalyst metal combinations include oxides and/or sulfides of cobalt-molybdenum, nickel-molybdenum, nickel-tungsten, nickel-molybdenum-tungsten, cobalt-nickel-molybdenum and the like. A suitable cobalt molybdenum catalyst is one comprising from about 1 to about 10 weight percent cobalt oxide and from about 5 to about 40 weight percent molybdenum oxide, especially about 2 to 5 weight percent cobalt and about 10 to 30 weight percent molybdenum. Methods for the preparation of these catalysts are well known in the art. The active metals can be added to the support or carrier, typically alumina, by impregnation from aqueous solutions followed by drying and calcining to activate the composition. Suitable carriers include, for example, activated alumina, activated alumina-silica, zirconia, titania, etc., and mixtures thereof. Activated clays, such as bauxite, bentonite and montmorillonite, can also be employed.

These and other features of the present process will be better understood by reference to the following demonstration of prior art runs conducted without benefit of the added heterocyclic oxygen or sulfur compound, and to exemplary comparative data obtained by liquefying the coal slurries in accordance with this invention, i.e., with added heterocyclic oxygen and sulfur compounds. All units are in terms of weight unless otherwise specified.

EXAMPLES

Stainless steel tubing bombs of 30 ml. capacity were charged with slurries of -100 mesh (Tyler) Illinois NO. 6 coal in various solvents at solvent-to-coal ratios of 2:1, with 2 percent added molecular hydrogen, based on the weight of coal. One set of the bombs was agitated at 120 cycles per minute for 130 minutes (Runs 1–2 and 4–5) and another was agitated at the same rate for 40 minutes (Runs 6–7 and 9) in a fluidized sandbath heated sufficiently to provide reaction temperatures. Various other conditions of operation, the nature of the solvent systems, and the results of these runs are given in Tables 1 and 2.

The data in Tables 1 and 2 thus clearly show, inter alia, the following advantages, to wit:

TABLE 1

| Run No. | 1 | 2 | 4 | 5 |
|---|---|---|---|---|
| Liquefaction Information | | | | |
| Temperature, ° F. | 760 | 760 | 760 | 760 |
| Pressure, psig | 1675 | 1675 | 1500 | 1500 |
| Residence Time, min. | 130 | 130 | 130 | 130 |
| Solvent Type | Tetralin + cyclopentanone | Tetralin + tetrahydrofuran | Tetralin + dibenzothiophene | Tetralin |
| Dry Feed, g | 3.00 | 3.00 | 3.00 | 3.00 |
| Solvent, g | 4.80 + 1.20 | 4.80 + 1.20 | 4.80 + 1.20 | 6.00 |
| $H_2$ Feed, Wt. % Dry Coal | 2.00 | 2.00 | 2.00 | 2.00 |
| Chemical Analysis | | | | |
| Ash, Wt. % Solid Residue | 15.56 | 17.75 | 18.18 | 15.77 |
| Yields, Wt. % Dry Coal | | | | |
| $H_2$ Consumption | 0.18 | — | 0.24 | 0.04 |
| Gas Make | 5.10 | 12.36 | 4.53 | 4.50 |
| $H_2$ | — | 0.11 | — | — |
| $CO_x$ | 2.73 | 6.27 | 1.75 | 1.80 |
| $H_2S$ | 0.33 | 0.26 | 0.47 | 0.44 |
| $C_1$–$C_3$ | 1.86 | 4.99 | 2.15 | 2.10 |
| $C_4$+ | 0.18 | 0.84 | 0.16 | 0.16 |
| $H_2O$ Make | 6.00 | 3.71 | 6.29 | 6.77 |
| Solid Residue | 57.1 | 50.0 | 48.8 | 56.3 |
| Liquid Make | 32.0 | 33.9 | 40.6 | 32.5 |
| Conversion | 42.9 | 50.0 | 51.2 | 43.7 |

TABLE 2

| Run No. | 6 | 7 | 9 |
|---|---|---|---|
| Liquefaction Information | | | |
| Temperature, ° F. | 813 | 813 | 820 |
| Pressure, psig | 2250 | 1800 | |
| Residence Time, min. | 40 | 40 | 40 |
| Solvent Type | Tetralin + tetrahydrofuran | Tetralin + dibenzofuran | Tetralin |
| Dry Feed, g | 3.00 | 3.00 | 3.00 |
| Solvent,g | 4.80 + 1.20 | 4.80 + 1.20 | 6.00 |
| $H_2$Feed, Wt. % Dry Coal | 2.0 | 2.0 | 2.0 |
| Chemical Analysis | | | |
| Ash, Wt. % Solid Residue | 22.55 | 21.35 | 19.39 |
| Yields, Wt. % Dry Coal | | | |
| $H_2$ Consumption | — | 0.22 | 0.15 |
| Gas Make | 17.36 | 5.83 | 6.52 |
| $H_2$ | 0.65 | — | — |
| $CO_x$ | 9.09 | 1.65 | 1.97 |
| $H_2S$ | 0.33 | 0.88 | 0.71 |
| $C_1$–$C_3$ | 6.82 | 2.99 | 3.62 |
| $C_4$+ | 0.47 | 0.31 | 0.22 |
| $H_2O$ Make | 3.71 | 6.75 | 8.32 |
| Solid Residue | 44.7 | 47.2 | — |
| Liquid Make | 34.3 | 40.5 | 33.4 |
| Conversion | 55.3 | 52.8 | 48.1 |

Referring first to Table 1, comparison of Runs 4 and 5 shows that the presence of dibenzothiophene produces a major advantage in increasing liquids yield, and in the amount of conversion. These data thus show an increase of 8.1 percent liquids (40.6–32.5), and an increase of 7.5 percent in the level of conversion when the solvent used in the reaction contains dibenzothiophene, as contrasted with a solvent which did not include dibenzothiophene. The gas make in the two runs is essentially the same.

Referring to Table 2, comparison of Runs 7 and 9 also shows advantages in the use of a solvent which contains dibenzofuran as contrasted with a solvent otherwise similar except that it contains no dibenzofuran. Referring to the data, it will thus be observed that the solvent used in Run 7 contained dibenzofuran whereas the solvent used in Run 9 did not. The run which employed dibenzofuran, i.e., Run 7, thus produced 7.1 percent more liquid than was produced in Run 9, and 4.7 percent higher conversion than was produced in Run 9.

Whereas tetrahydrofuran (Runs 2 and 6) provided high conversion, the excess gases that were produced make the use of these species undesirable. It is also to be noted (Run 1) that the use of cyclopentanone was ineffective.

It is apparent that various modifications can be made in the process without departing the spirit and scope of the present invention.

Having described the invention, what is claimed is:

1. A process for producing coal liquids by the conversion of coal at coal liquefaction conditions, which comprise:

passing through a liquefaction zone at temperatures ranging from about 700° F to about 950° F, and pressures ranging from about 300 psia to about 300 psia, coal slurried in a solvent containing at least about 0.8 percent donatable hydrogen, based on the weight of solvent, to which has been added in quantity ranging from about 3 to about 50 percent, based on the weight of total solvent, a polar, stable compound characterized as i. a low molecular weight heterocyclic oxygen compound containing from two to about six fused rings, one or more of which is a five- or six-membered heterocyclic ring having from 4 to 5 carbon atoms in the nucleus, and from one to two atoms of oxygen; or ii. a low molecular weight heterocyclic sulfur compound containing from two to about six fused rings, one or more of which is a five- or six-membered heterocyclic ring having from 4 to 5 carbons atoms in the nucleus, and from one to two atoms of sulfur sufficient to increase the yields of liquids produced from said coal.

2. The process of claim 1 wherein the added compound is one containing one heterocyclic atom in its nucleus.

3. The process of claim 2 wherein the added compound is one containing from 8 to about 36 carbon atoms in a total molecule.

4. The process of claim 1 wherein the added compound is comprised of from two to three fused rings, at least one of which contains one heterocyclic atom in its nucleus.

5. The process of claim 4 wherein the heterocyclic atom is oxygen.

6. The process of claim 3 wherein said added compound is present in amounts of from about 5 to about 20 weight percent, based on total solvent.

7. The process of claim 2 wherein said added compound is one boiling within a range of from about 250° F. to about 850° F.

8. The process of claim 7 wherein said added compound boils within a range of from about 290° F. to about 700° F.

9. The process of claim 7 wherein said added compound is introduced into said liquefaction zone in admixture with a recycle stream produced within said coal liquefaction process, said recycle stream boiling within the range from about 350° F. to about 850° F.

10. The process of claim 9 wherein the recycle stream boils within a range of from about 400° F to about 700° F.

11. The process of claim 10 wherein said recycle stream boils within a range of from about 400° F. to about 700° F.

12. The process of claim 1 wherein the slurry of coal is also contacted with molecular hydrogen in said liquefaction zone at a treat rate of from about 1 to about 6 weight percent (MAF coal basis).

13. The process of claim 1 wherein the temperature maintained within the reaction zone ranges from about 800° F to about 850° F.

14. The process of claim 1 wherein the pressure maintained within the reaction zone ranges from about 800 psia to about 2000 psia.

15. The process of claim 1 wherein the solvent contains from about 1.2 to about 3 percent of donatable hydrogen.

16. The process of claim 1 wherein the solvent is admixed with the coal to provide a solvent-to-coal ratio ranging from about 0.8:1 to about 4:1.

17. A process for producing coal liquids which comprises: liquefying a slurry of coal in a hydrogen-donor solvent at coal liquefaction conditions in the presence of an added compound characterized as a low molecular weight heterocyclic sulfur compound containing from two to three fused rings, one or more of which is a five- or six-membered heterocyclic ring having from 4 to 5 carbon atoms, at least one of which contains one heterocyclic sulfur atom in its nucleus, sufficient to increase the yields of liquids produced from said coal.

18. A process for liquefying a particulate coal feed to produce useful petroleum-like liquid products, in a series of steps which includes: (a) contacting, in a liquefaction zone, said coal feed which is slurried in a hydrogen donor solvent at temperature and pressure sufficient to hydroconvert and liquefy the coal (b) separating the product from the liquefaction zone by distillation into fractions inclusive of a liquid fraction boiling within about a 350°–850° F range, and which contains at least 30 weight percent hydrogen donor compounds, (c) hydrogenating said liquid 350°–850° F fraction in a hydrogenation zone, (d) adding to said 350°–850° F liquid fraction from about 3 to about 50 weight percent of a solvent characterized as a low molecular weight heterocyclic oxygen or heterocyclic sulfur compound containing, within a molecule, from two to about six fused rings, one or more of which is a five- or six-membered heterocyclic ring having 4 to 5 carbon atoms and from one to two atoms of oxygen or sulfur, and (e) recycling the hydrogenated liquid solvent mixture to said coal liquefaction zone.

19. The process of claim 18 wherein the fraction of about 350°–850° F range contains at least 50 weight percent hydrogen donor compounds.

20. The process of claim 19 wherein the fraction is one boiling within a range of from about 400°–700° F.

21. The process of claim 18 wherein from about 5 to about 20 percent of the heterocyclic compound is added to the hydrogen donor solvent.

* * * * *